United States Patent [19]

Henry et al.

[11] Patent Number: 4,567,349

[45] Date of Patent: Jan. 28, 1986

[54] HEAT AND PRESSURE FUSER APPARATUS

[75] Inventors: Arnold W. Henry, Pittsford; Rabin Moser, Fairport, both of N.Y.

[73] Assignee: Xerox Corporation, Stamford, Conn.

[21] Appl. No.: 441,583

[22] Filed: Nov. 15, 1982

[51] Int. Cl.[4] ..... G03G 15/20

[52] U.S. Cl. ..... 219/216; 355/3 FU

[58] Field of Search ..... 219/216, 469–471; 432/60, 228; 355/3 FU

[56] References Cited

U.S. PATENT DOCUMENTS

| | | | |
|---|---|---|---|
| T947,012 | 6/1976 | Brandon | 219/216 |
| 3,268,351 | 8/1966 | Van Dorn . | |
| 3,449,548 | 6/1969 | Adamek | 219/216 |
| 3,669,706 | 6/1972 | Sanders | 219/216 |
| 3,809,854 | 5/1974 | Sanders | 219/216 |
| 3,811,821 | 5/1974 | Ariyama | 432/60 |
| 3,884,623 | 5/1975 | Slack | 219/216 |
| 3,912,901 | 10/1975 | Strella | 219/216 |
| 3,948,214 | 4/1976 | Thettu | 432/60 |
| 4,001,544 | 1/1977 | Heinzer | 219/216 |
| 4,013,871 | 3/1977 | Namiki | 219/469 |
| 4,095,886 | 6/1978 | Koeleman | 219/216 |
| 4,197,445 | 4/1980 | Moser | 219/216 |
| 4,199,626 | 4/1980 | Stryjewski | 355/3 FU |
| 4,219,327 | 8/1980 | Idstein | 355/3 FU |
| 4,265,990 | 5/1981 | Stolka | 430/59 |
| 4,329,565 | 5/1982 | Namiki | 219/216 |
| 4,420,680 | 12/1983 | Itoh | 219/216 |

FOREIGN PATENT DOCUMENTS

| | | | |
|---|---|---|---|
| 0002230 | 6/1979 | European Pat. Off. . | |
| 0002303 | 6/1979 | European Pat. Off. | 355/3 FU |
| 0006716 | 1/1980 | European Pat. Off. . | |
| 0009391 | 4/1980 | European Pat. Off. . | |
| 0018140 | 10/1980 | European Pat. Off. . | |
| 0035810 | 9/1981 | European Pat. Off. . | |

*Primary Examiner*—C. L. Albritton
*Assistant Examiner*—Teresa J. Walberg

[57] ABSTRACT

A heat and pressure fuser apparatus for fixing toner images to a substrate. The apparatus is characterized by the fact that silicone oil release agent material which is usually required for such devices is unnecessary. The fuser member which contacts the toner images comprises an outer layer of solid adhesive material capable of retaining this property without degradation over the operating life of the apparatus. The fuser member is so constructed that the abhesive coating contributes to the formation of the nip created between the fuser member and a backup roller.

9 Claims, 5 Drawing Figures

HEAT AND PRESSURE FUSER APPARATUS

This invention relates, in general, to apparatus for fixing toner images to a substrate and, in particular, to a heat and pressure fuser which can be used without the application of release agent material.

The present invention is particularly useful in the field of xerography where images are electrostatically formed upon a member and developed with resinous powders known as toners, and thereafter fused or fixed onto sheets of paper or other substrates to which the powder images have been transferred. The resin-based powders or toners are generally heat and/or pressure softenable, such as those provided by toners which contain thermoplastic resins and have been used conventionally in a variety of commercially known methods.

In order to fuse images formed of the resinous powders or toners, it is necessary to heat the powder, to submit the powder to pressure or to use a combination of heat and pressure to fix or fuse the resinous powders or toners to a particular substrate. Temperature and/or pressure ranges will vary depending upon the softening range of the particular resin used in the toner. When heat is used in conjunction with pressure to fuse the images to a substrate, it is generally necessary to heat the toner powder using fuser rolls heated to a prenip temperature in excess of about 180° C. or higher. Temperatures as high as 193° C. or even higher are not uncommon in commercially known methods and devices. Corresponding nip pressure is on the order of 100–200 PSI.

It has long been recognized that one of the fastest and most positive methods of applying heat for fusing the powder image is by direct contact of the resin-based powder with a hot surface, such as a heated roll while pressure is being applied to the substrate to which the powder image is to be fused or fixed. But, in most instances, the powder image is tackified by the heat and/or pressure, part of the image carried by the support material will stick to the surface of the plate or roll or any other configuration so that as the next sheet is advanced on the heated surface, the tackified image, partially removed from the first sheet, will partly transfer to the next sheet and at the same time part of the tackified image from said next sheet would adhere to the heated surface. This process is commonly referred to in the art as "offset," a term well known in the art.

The offset of toner onto the heated surface led to the development of improved methods and apparatus for fusing the toner image. These improvements comprised fusing toner images by forwarding the sheet or web of substrate material bearing the image between two rolls at least one of which was heated, the rolls contacting the image being provided with a thin (i.e. 0.0001–0.003 inch) coating of tetrafluoroethylene resin and a silicone oil film to prevent toner offset. The outer surfaces of such rolls have also been fabricated of fluorinated ethylene propylene or silicone elastomers coated with silicone oil as well as silicone elastomers containing low surface energy fillers such as fluorinated organic polymers, and the like. The tendency of these rolls to pick up the toner generally requires some type of release fluid to be continuously applied to the surface of the roll to prevent such offset, and commonly known silicone oils are generally well adapted for this purpose. Not only are the polydimethyl-siloxane fluids well known for this purpose but certain functional polyorganosiloxane release agents have also been described for this purpose. It is also well known to utilize fluids of low viscosity, for example, 100–200 centistokes as well as fluids of relatively high viscosity, for example, 12,000 centistokes to 60,000 centistokes and higher.

These fluids are applied to the surface of the heated roll by various devices known as release agent management (RAM) systems, the most common of which comprises a wick structure supported in physical contact with the fuser roll. It has long been recognized that the inclusion of a release agent management system as a necessary part of a fuser design represents a significant percentage of the cost of fusing toner images. Not only is the cost of a RAM system undesirable but use of oily fluids per se is undesirable because they contaminate other parts of the machine in which they are used.

In accordance with the present invention we have provided an improved heat and pressure fuser apparatus for fixing toner images to copy substrates. In particular, a fuser apparatus is disclosed which does not require the application of release agent material in order to prevent toner offset. To this end, the fuser apparatus of the present invention comprises a heated roller comprising an abhesive (i.e. low affinity for softened toner materials or the like) material for the outer surface thereof which is adapted to deform when pressure engaged with a rigid backup roller, the degree of deformation being of a magnitude such that it contributes to the formation of a nip between the fuser and backup rollers through which the copy substrates carrying the toner images thereon are moved with the toner images contacting the heated roller. Another important aspect of the abhesive material is that it possesses the capability of continued use in the fuser environment without the loss of it's abhesive property. Examples of suitable abhesive materials are fluorinated polymers and copolymers such as polytetrafluoroethylene (PTFE), fluorinated ethylene propylene (FEP) and perfluoroalkoxy/tetrafluoroethylene (PFA).

For a general understanding of the features of the present invention, a description thereof will be made with reference to the drawings wherein:

FIG. 1 schematically depicts the various components of an illustrative electrophotographic machine incorporating the invention;

Inasmuch as the art of electrophotography is well known, the various processing stations employed in the printing machine illustrated in the FIG. 1 will be described only briefly.

Figure 1:
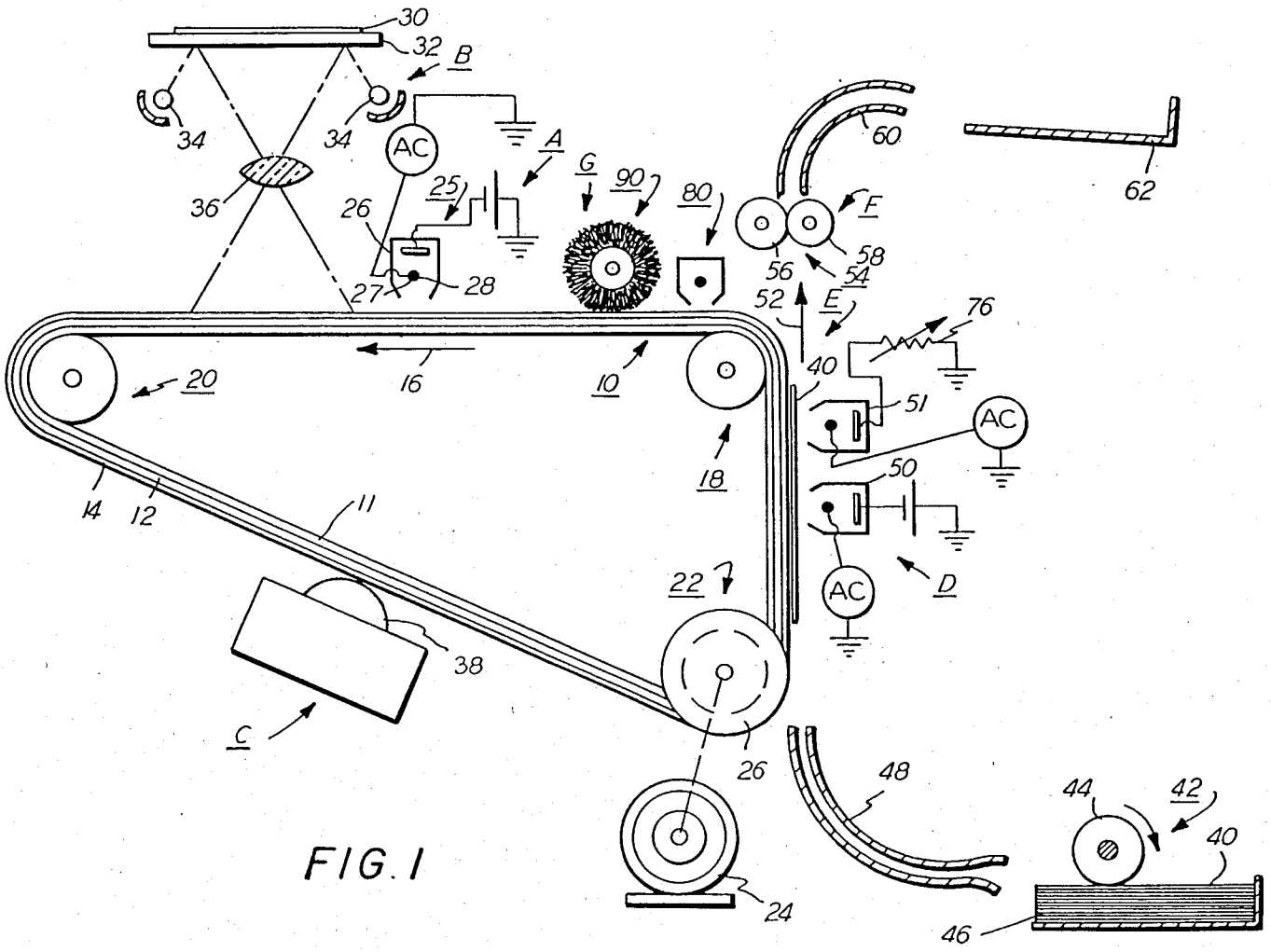

As shown in FIG. 1, the machine utilizes a photoconductive belt 10 which consists of an electrically conductive substrate 11, a charge generator layer 12 comprising photoconductive particles randomly dispersed in an electrically insulating organic resin and a charge transport layer 14 comprising a transparent electrically inactive polycarbonate resin having dissolved therein one or more diamines. A photoreceptor of this type is disclosed in U.S. Pat. No. 4,265,990 issued May 5, 1981 in the name of Milan Stolka et al, the disclosure of which is incorporated herein by reference. Belt 10 moves in the direction of arrow 16 to advance successive portions thereof sequentially through the various processing stations disposed about the path of movement thereof. Belt 10 is entrained about stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as belt drive.

Belt 10 is maintained in tension by a pair of springs (not shown) resiliently urging tension roller 20 against belt 10 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device, indicated generally by the reference numeral 25, charges the belt 10 to a relatively high, substantially uniform negative potential. A suitable corona generating device for negatively charging the photoconductive belt 10 comprises a conductive shield 26 and a dicorotron electrode comprising an elongated bare wire 27 and a relatively thick electrically insulating layer 28 having a thickness which precludes a net d.c. corona current and when an a.c. voltage is applied to the corona wire and when the shield and the photoconductive surface are at the same potential. Stated differently, in the absence of an external field supplied by either a bias applied to the shield or a charge on the photoreceptor there is substantially no net d.c. current flow.

Next, the charged portion of photoconductive belt is advance through exposure station B. At exposure station B, an original document 30 is positioned facedown upon transparent platen 32. Lamps 34 flash light rays onto original document 30. The light rays reflected from original document 30 form light images which are transmitted through lens 36. The light images are projected onto the charged portion of the photoconductive belt to selectively dissipate the charge thereon. This records an electrostatic latent image on the belt which corresponds to the informational area contained within original document 30. Alternatively, the exposure station B could contain an electrographic recording device for placing electrostatic images on the belt 10 in which case, the corona device 25 would be unnecessary.

Thereafter, belt 10 advances the electrostatic latent image to development station C. At development station C, a magnetic brush developer roller 38 advances a developer mix (i.e. toner and carrier granules) into contact with the electrostatic latent image. The latent image attracts the toner particles from the carrier granules thereby forming toner powder images on the photoconductive belt.

Belt 10 then advances the toner powder image to transfer station D. At transfer station D, a sheet of support material 40 is moved into contact with the toner powder images. The sheet of support material is advanced to transfer station D by a sheet feeding apparatus 42. Preferably, sheet feeding apparatus 42 includes a feed roll 44 contacting the upper sheet of stack 46. Feed roll 44 rotates so as to advance the uppermost sheet from stack 46 into chute 48. Chute 48 directs the advancing sheet of support material into contact with the belt 10 in timed sequence so that the toner powder image developed thereon contacts the advancing sheet of support material at transfer station D.

Transfer station D includes a corona generating device 50 which sprays negative ions onto the backside of sheet 40 so that the toner powder images which comprise positive toner particles are attracted from photoconductive belt 10 to sheet 40. For this purpose, approximately 50 microamperes of negative current flow to the copy sheet is effected by the application of a suitable corona generating voltage and proper bias.

Subsequent to transfer the image sheet moves past a detack corona generating device 51 positioned at a detack station E. At the detack station the charges placed on the backside of the copy sheet during transfer are partially neutralized. The partial neutralization of the charges on the backside of the copy sheet thereby reduces the bonding forces holding it to the belt 10 thus enabling the sheet to be stripped as the belt moves around the rather sharp bend in the belt provided by the roller 18. After detack, the sheet continues to move in the direction of arrow 52 onto a conveyor (not shown) which advances the sheet to fusing station F.

Fusing station F includes a fuser assembly, indicated generally by the reference numeral 54, which permanently affixes the transferred toner powder images to sheet 40. Preferably, fuser assembly 54 includes a heated fuser member in the form of a roller 56 adapted to be pressure engaged with a backup roller 58. Sheet 40 passes between fuser roller 56 and backup roller 58 with the toner powder images contacting fuser roller 56. In this manner, the toner powder image is permanently affixed to sheet 40. After fusing, chute 60 guides the advancing sheet 40 to catch tray 62 for removal from the printing machine by the operator.

Figure 2:
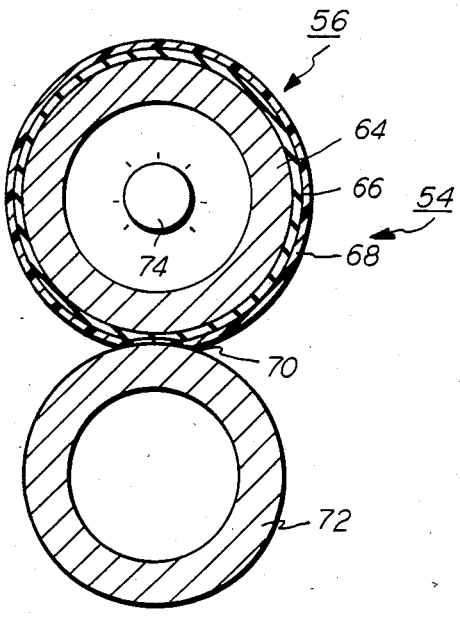
FIG. 2 is a schematic representation of a fuser apparatus incorporating one embodiment of the invention.

The heated roller 56, as illustrated in FIG. 2, comprises a rigid metal core 64 to which there is adhered a relatively thin resilient (i.e. approx. 0.008 inch thick) layer 66 of Viton or any other suitable elastomeric material such as silicone rubber. Viton is a trademark of E. I. Dupont de Nemours and Co. for a series of fluoroelastomers based on the copolymer of vinylidene fluoride and hexafluoropropylene and terpolymers of vinylidene fluoride, hexafluoropropylene and tetrafluoroethylene. An outer covering 68 of solid abhesive (i.e. low affinity for softened toner) material that is capable of maintaining its abhesive character throughout the life of the fuser which life may last several hundred thousand fused copies. By solid is meant the abhesive material contains no liquid release material and is incapable of producing liquid release material. Typical materials comprise fluorinated polymers and copolymers such as polytetrafluoroethylene (PFTE), fluorinated ethylene propylene (FEP) and perfluoroalkoxy/tetrafluoroethylene (PFA).

Heretofore, such polymers and copolymers when utilized for fusing toner images required the use of silicone oil applied thereto, e.g., as disclosed in U.S. Pat. No. 3,268,351 issued in the name of Warren VanDorn. However, we have found that by constructing the heated fuser member such as the heated roller 56 such that the abhesive covering 68 contributes to the formation of a nip 70 formed between the fuser roller 56 and a rigid backup roller 72 when the two rollers are pressure engaged that the silicone oil is unnecessary. In the embodiment of FIG. 2 the resilient layer 66 permits deformation or indenting of relatively thin (i.e., 0.005 to 0.010 inch) outer layer 68 by the backup roller 72 to form the nip 70. The roller 56 is internally heated by means of a conventional heat source 74. The heat source 74 is controlled in a conventional manner such that surface temperature of the roll runs on the order of 132° to 166° C. These temperatures are adequate to fuse conventional heat settable toners when the pressure exerted in the nip is about 800 PSI.

Figure 3:
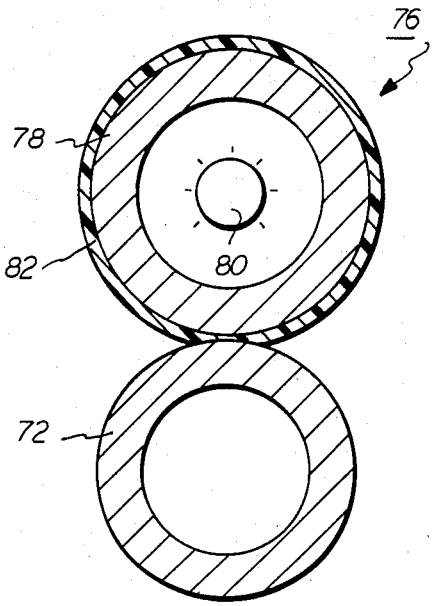
FIG. 3 is a schematic representation of a fuser apparatus incorporating a modified embodiment of the invention.

As viewed in FIG. 3, a modified form 76 of the fuser roller 56 is illustrated. The roller 76 comprises a rigid core 78 having a heat source 80 supported internally thereof and a relatively thick (i.e. 0.020 inch) outer coating 82 abhesive material. Due to the coating 82 being relatively thick it is capable of being indented or deformed to form the nip 70. Again, as in the case of the embodiment of FIG. 2 no silicone oil is necessary due to the abhesive nature of the material and the thickness thereof which allows the material to contribute to the formation of the nip. The commercial fuser based on the aforementioned U.S. Pat. No. 3,268,351 patent which comprises PTFE must have silicone applied thereto otherwise the toner forming the images will offset to the PTFE materal. The U.S. Pat. No. 3,268,351 type of fuser roller comprises a PTFE coating adhered to a rigid core, the thickness of the coating being only 0.001 to 0.003 inches. Thus, such a coating is not sufficiently deformable to allow use of the fuser roll without the silicone.

Figure 4:
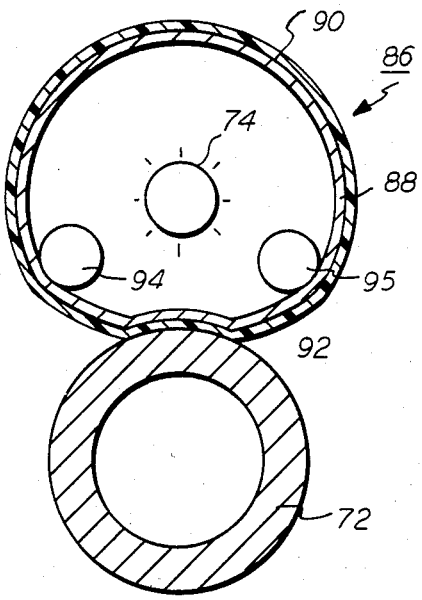
FIG. 4 is a further modification of the invention.

Another embodiment of the fuser apparatus of the present invention as illustrated in FIG. 4 comprises heated fuser member 86 fabricated from a relatively thin metal shell 88 overcoated with a relatively thin layer 90 of abhesive material as discussed hereinabove. The shell thickness is on the order of 0.010 inch and the thickness of the layer 90 is in the range of 0.001 to 0.003 inches. As will be appreciated the thickness of the shell together with the layer 90 is small enough that this structure is relatively flexible, therefore, it can conform to the radius of the rigid backup roll to thereby form a nip 92. As in the case of the other embodiments the fuser member is internally heated by means of heat source 74. A pair of positioning rolls 94 and 95 cooperate with the shell 88 to guide the fuser member into proper nip forming contact with the backup roller 72.

Figure 5:
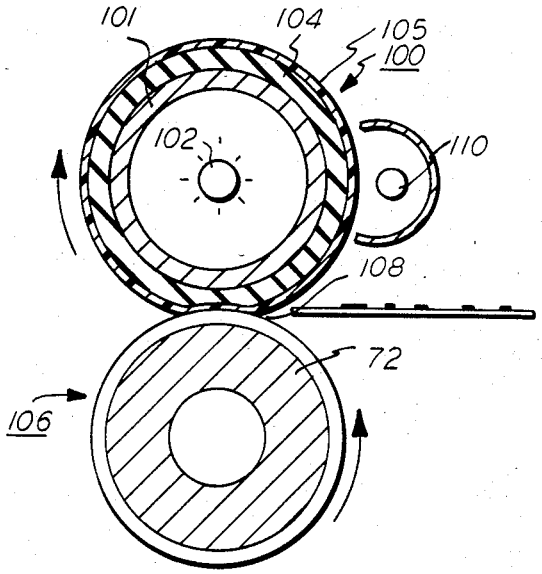
FIG. 5 is yet a further modification of the invention.

As illustrated in FIG. 5 still another embodiment of the fuser comprises a heated fuser roll 100 comprising a rigid metal core 101 having a heating element 102 supported internally thereto. A relatively thick (i.e. 0.30 inch) deformable layer 104 of Viton is adhered to the core and the layer 104 is covered with a relatively thin (0.001–0.002 inch) abhesive material 105 of the type mentioned hereinabove. The pressure roll 106 is rigid so as to cause the layer 104 to deform thereby forming the nip 108 between the two rolls. An external source of heat 110 is provided for maintaining the surface temperature of the fuser roll at the fusing temperature during the run mode of operation, the heating element 102 providing the energy to maintain the fuser roll at a predetermined standby temperature. A suitable control (not shown) can be employed to first energize the internal heating element during standby and then actuate the external heating element with simultaneous de-energization of the heating element. Such a control is disclosed in U.S. Pat. No. 4,197,445 granted on Apr. 8, 1980 to Moser.

It should now be apparent that the present invention discloses a heat and pressure fuser apparatus which does not require the use of silicone oil. To this end, the fuser member that contacts the toner images on the carrier substrate comprises abhesive material as the outer coating thereof that will function as such for an extended period of time. The fuser member is fabricated such that the abhesive material contributes to the formation of the nip between it and a backup roll.

We claim:

1. Heat and pressure fuser apparatus for fixing toner images to a copy substrate, said apparatus comprising:

a fuser member comprising a rigid metal core overcoated only with a solid abhesive material, the material being selected from the group consisting of fluorinated polymers and copolymers;

means for elevating the surface temperature of said fuser member;

a backup member adapted to be pressure engaged with said fuser member to thereby form a nip between the two members, said fuser member being deformable by said backup member whereby said fuser member contributes to the formation of said nip;

and means for conveying copy substrates through said nip without applying release agent material to said fuser member.

2. Apparatus according to claim 1 wherein said abhesive material comprises polytetrafluoroethylene.

3. Apparatus according to claim 1 wherein said abhesive material comprises fluorinated ethylene propylene.

4. Apparatus according to claim 1 wherein said abhesive material comprises a copolymer of perfluoroalkoxy and tetrafluoroethylene.

5. Apparatus according to claim 1 wherein said abhesive material is adhered to said rigid metal core and has a thickness on the order of 0.20 inch.

6. Apparatus according to claim 1 wherein said abhesive material comprises a terpolymer.

7. Apparatus according to claim 1 wherein said surface temperature elevating means comprises a heating element supported internally of said fuser member.

8. Apparatus according to claim 1 wherein said surface temperature elevating means comprises an external heating element.

9. Apparatus according to claim 8 further including an internal heating element.

* * * * *